US005162776A

United States Patent [19]

Bushnell et al.

[11] Patent Number: 5,162,776

[45] Date of Patent: Nov. 10, 1992

[54] EMERGENCY SERVICE APPARATUS AND METHOD

[75] Inventors: Robert A. Bushnell, Bedford; Stewart B. French, Waltham; Charles B. Abbott, South Attleboro, all of Mass.

[73] Assignee: Lifeline Systems, Inc., Watertown, Mass.

[21] Appl. No.: 727,569

[22] Filed: Jul. 9, 1991

[51] Int. Cl.[5] ..... G08B 23/00

[52] U.S. Cl. ..... 340/501; 340/531; 340/502; 340/573

[58] Field of Search ..... 340/531, 502, 501, 539, 340/573, 825.06

[56] References Cited

U.S. PATENT DOCUMENTS

| | | | |
|---|---|---|---|
| 3,914,692 | 10/1975 | Seaborn, Jr. | 340/502 |
| 4,724,538 | 2/1988 | Farrell | 340/539 |
| 4,884,059 | 11/1989 | Shapiro | 340/531 |
| 4,884,060 | 11/1989 | Shapiro | 340/531 |
| 5,032,823 | 7/1991 | Bower et al. | 340/531 |
| 5,045,839 | 9/1991 | Ellis et al. | 340/531 |

*Primary Examiner*—Jin F. Ng
*Assistant Examiner*—Dov Popovici
*Attorney, Agent, or Firm*—Weingarten, Schurgin, Gagnebin & Hayes

[57] ABSTRACT

An apparatus and method for providing a positive indication at a central monitoring station of a personal emergency response system that a responder has arrived at a subscriber's location and has taken responsibility for the subscriber's aid.

5 Claims, 2 Drawing Sheets

EMERGENCY SERVICE APPARATUS AND METHOD

FIELD OF THE INVENTION

This invention relates generally to the field of emergency response systems and particularly to personal monitoring systems.

BACKGROUND OF THE INVENTION

With an increasing percentage of the population comprising elderly or infirm persons living alone, the demand for a means to monitor the well-being of these individuals has increased. Although periodic visits by other individuals, such as visiting nurses or family members, provide a measure of security, and while the telephone provides a means for summoning help in an emergency, many situations immediately come to mind whereby an incapacitating emergency, such as a fall, occurs between such visits and when an individual is located some distance away from their phone.

As a result of this problem, a number of service businesses have formed which provide a monitoring service for people living alone. Typically, a person, called a subscriber, wishing to be monitored, is supplied with a home communicator. The home communicator links the person's home either by telephone or radio with a central monitoring station. Also typically, the subscriber is provided with a small personal communicator which is worn by the subscriber and which is in radio communication with the home communicator. In the event of an emergency the subscriber need only press a button on the personal communicator to cause the home communicator to notify the central monitoring station that the subscriber requests help.

When the central monitoring station receives the help call from the home communicator, the central monitoring station then proceeds to call one or more individuals, called responders, who proceed to the subscriber's home to provide assistance. Once a responder has accepted the responsibility for the call, the central monitoring station typically ceases to be involved.

SUMMARY OF THE INVENTION

The invention relates to a system and method for providing a positive indication at a central monitoring station that a responder has arrived at the subscriber's location and has taken responsibility for providing aid to the subscriber. The system includes a subscriber station which is able to communicate with the central monitoring station over a telephone network.

In one embodiment, the subscriber station includes a home communicator, a personal communicator, and a visual and/or audible annunciator such as a loudspeaker. When the subscriber requires aid, the subscriber activates the personal communicator which in turn activates the home communicator or activates the home communicator directly. The home communicator then places a help-call to the central monitoring station. The central monitoring station instructs the subscriber station to activate the annunciator to periodically emit a tone from a loudspeaker. This tone indicates to the subscriber that the central monitoring station is aware that no responder has as yet arrived at the subscriber's location and serves to remind the responder to notify the central station of the responder's arrival.

Simultaneously with the arrival of the help-call from the home communicator, a timer at the central monitoring station is started. This timer provides periodic notices warning the central monitoring station personnel that the subscriber still has not received aid. In this way, should the lack of aid persist, appropriate action may be taken. At this time, the communications between the central station and the home communicator may be terminated.

Once a responder arrives at the subscriber's location, the responder again activates the personal communicator or a help-call button on the home communicator. This causes a second help-call to be transmitted to the central station. This second help-call from the home communicator causes the tone generation at the subscriber station to terminate and notifies the central monitoring station that the responder has arrived at the subscriber's location. The central monitoring station then terminates the periodic warning notices to the central monitoring station personnel. Additionally, personnel at the central monitoring station may now remain in communication with the responder upon receipt of this second help call to offer further assistance.

DESCRIPTION OF THE DRAWINGS

These and further advantages of the invention are more readily understood with reference to the following description considered in conjunction with the accompanying drawings in which.

DESCRIPTION OF THE PREFERRED EMBODIMENT

Figure 1:
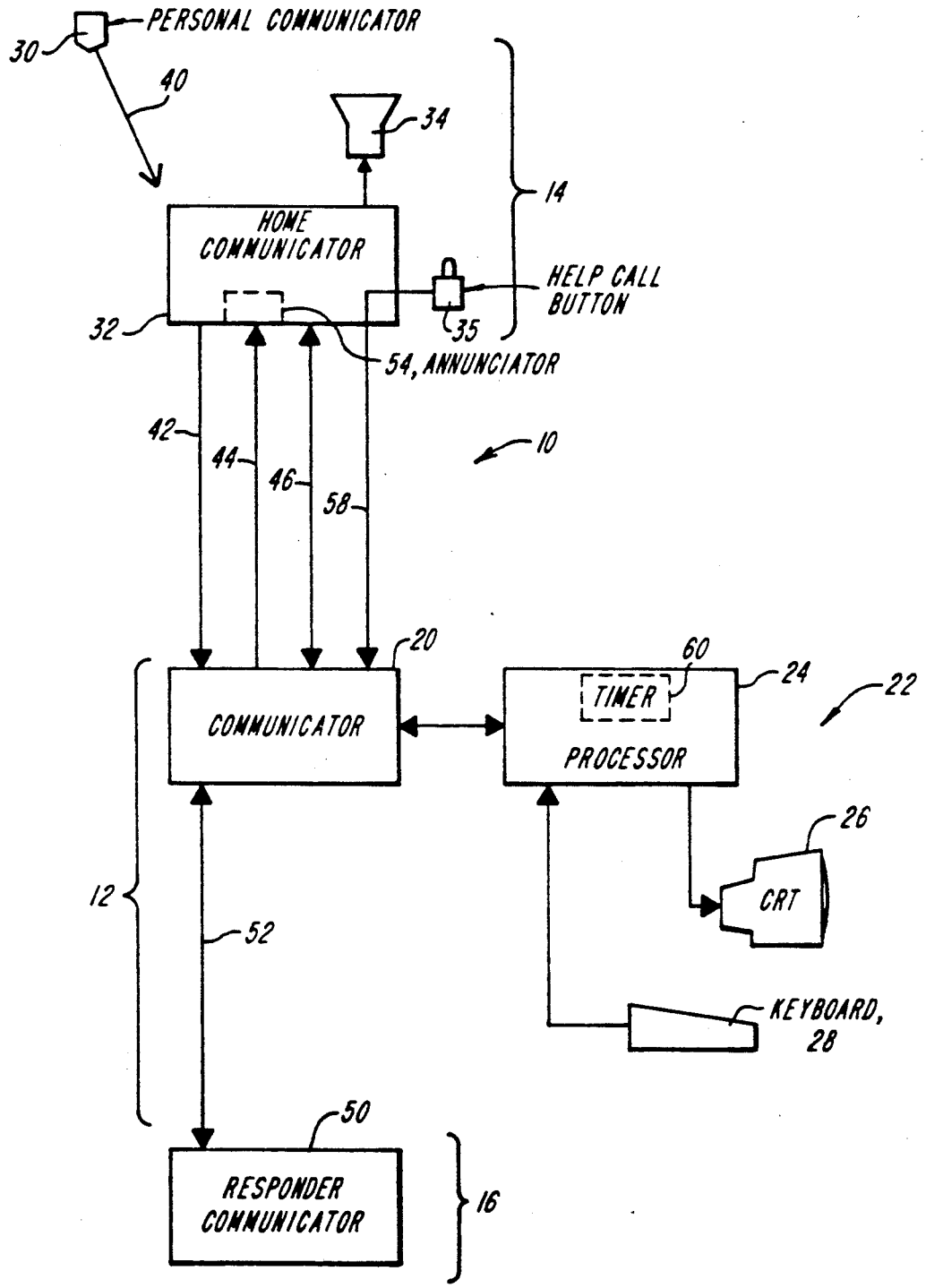
FIG. 1 is a block diagram of an embodiment of the system of the invention.

Referring to FIG. 1, an emergency response system 10 includes a central monitoring station 12, at least one subscriber station 14 and at least one responder station 16. The central monitoring station 12 includes a communicator 20 which is capable of providing two way communication both with the subscriber station 14 and with the responder station 16. A computer system 22, which includes a processor 24, a monitor screen 26 and a keyboard 28, controls the communicator 20 in response to commands typed on the keyboard 28.

The subscriber station 14 includes a home communicator 32 having a speaker 34 and a help-call button 35, and a portable personal communicator 30. The subscriber can activate the home communicator 32 to call the central monitoring station 12 to request help either by pressing a button on the portable personal communicator 30 or by pressing the help-call button 35 on the home communicator 32. The responder station 16 includes a responder communicator 50 by which the central monitoring station 12 communicates with the responder to provide information concerning the subscriber.

In brief overview of the operation of the system 10, a subscriber desiring help presses a button on the portable personal communicator 30 which in turn transmits a signal 40 to the home communicator 32. Alternatively, the subscriber may press the help-call button 35 on the home communicator 32. The home communicator 32 then establishes communication with the central monitoring station 12 over the telephone network. The reception of the call starts a central timer 60 which provides a periodic reminder to the personnel in the central monitoring station 12 monitoring the call that the help-call is still pending. Simultaneously, in response to the help-call signal 42, the call is assigned to one of the personnel in the central monitoring station 12. The person monitoring the call at the central monitoring station 12 then attempts to establish two-way communication 46 with the subscriber by means of the home communicator 32.

If the subscriber is responsive and verifies the request for help, the person monitoring the call asks the subscriber who the subscriber prefers as a responder. The central monitoring station 12 monitoring the subscriber then transmits a signal 44 to the home communicator 32 which starts a local annunciator 54. The local annunciator 54 periodically issues a tone (a beep) through the speaker 34 indicating to the subscriber that a responder is being notified and that the central monitoring station 12 is aware that the responder has not as yet arrived at the subscriber's home. In the embodiment disclosed herein, the tone is generated every 7 seconds.

The person in the central monitoring station 12 monitoring the call utilizes the monitor screen 26 and keyboard 28 of the computer system 22 to call the appropriate responder for the subscriber or, in the event that the requested responder is unavailable, another responder. The contact of the responder is by means of a signal 52 to the responder communicator 50.

If the subscriber is non-responsive, the person in the central monitoring station 12 monitoring the call signals the annunciator 54 in the home communicator 32 to begin beeping and then utilizes the monitor screen 26 and keyboard 28 of the computer system 22 to determine an appropriate responder for the subscriber and to contact that responder. Again, if the responder is unavailable, another responder is called. Once a responder has agreed to respond, the person at the central monitoring station 12 terminates communications with the subscriber.

Periodically the computer 24 displays on the monitor 26 a warning message that there has been no confirmation that help has arrived at the subscriber's home so that the person monitoring the situation may take appropriate action. In the embodiment disclosed herein, a warning message is issued every 30 minutes.

Once a responder has arrived at the subscriber's home to aid the subscriber, the responder either presses the help-call button 35 on the home communicator 32 or the button on the personal communicator 30. This action causes the home communicator 32 to terminate the annunciator 54 tone and to place another help-call to the central monitoring station 12. The reception of this second call from the home communicator 32 interrupts the central timer 60 and causes the display of a message on the monitor 26 that the responder has arrived and is taking responsibility for the subscriber. At this time the person in the central monitoring station 12 can either again terminate communications with the subscriber's home or may maintain communication with the responder in order to render further assistance.

Figure 2:
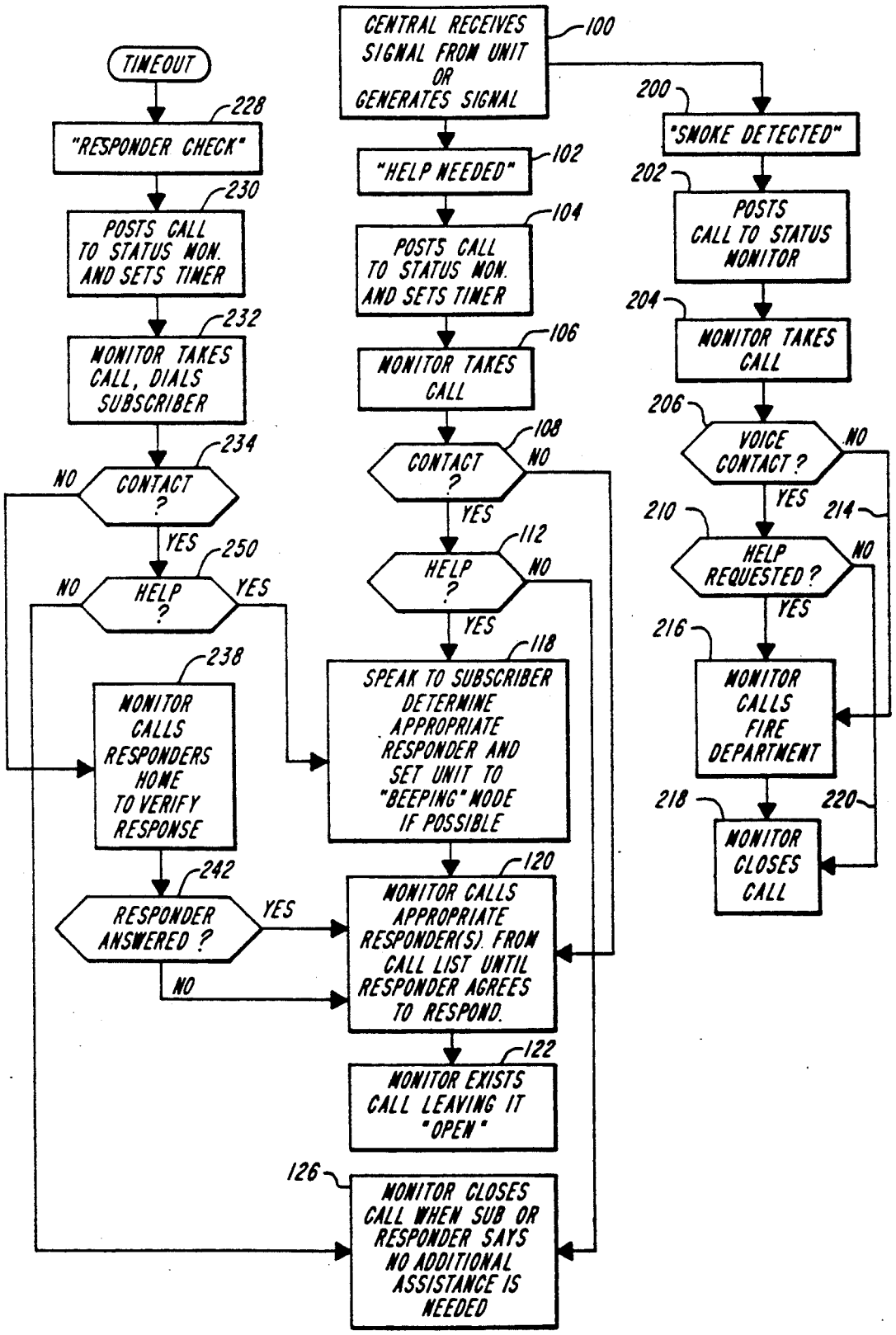
FIG. 2 is a flow diagram of the method of operation of the system of FIG. 1.

In more detail, a flow diagram of the steps taken by the system are depicted in FIG. 2. Operation begins with the reception 100 of a signal from a subscriber station 14 by the central monitoring station 12. If the station 12 determines (102) that the received signal is a help-request signal, the incoming request signal is assigned 104 to one of the personnel in the central station 12, and the central timer 60 is set 104. At this time, the computer system 22 also determines if the home communicator 32 at the subscriber's home is a model which is able to emit a tone. The person monitoring the call takes the call and attempts to contact the subscriber (106).

If contact with the subscriber is successful (108) and help (112) is requested, the person monitoring the call asks the subscriber (118) who the subscriber would prefer as a responder, and a signal 44 is sent to the subscriber station 14 to start the local annunciator 54 to initiate the periodic tone at the subscriber station 14 (if the computer system 22 has determined that the unit is capable of emitting a tone). At this time, the monitoring staff ends communicator with the subscriber and a responder selected by the subscriber is contacted (120). If the selected responder is unavailable, another responder from the list of responders available is selected and this process continues until a responder has been reached and agrees to respond. At this point the call to the subscriber is still considered "open" (122) but the personnel at the central monitoring station 12 have no further activity until the central timer 60 indicates that the call has not been answered by the responder within a predetermined amount of time (e.g. 30 minutes).

If it is determined that help (112) is not required 124, the person monitoring the call closes the call (126) using the keyboard 28, and no further action is required. Note that in this case, the local annunciator 54 is never activated and no reminder tones are heard by the subscriber.

If the subscriber is not responsive to a help inquiry (112), the monitor immediately determines an appropriate responder from the list of responders and calls that responder (120). Again, the call is considered "open" (122). In this case the local annunciator 54 is activated and a tone is heard at the subscriber's home communicator.

If the help-call button 35 or if the personal communicator button has not been pressed prior to the central timer 60 reaching the end of the predetermined time interval, the computer system 22 generates (228) a "responder-check" message on the monitor 26 and resets the central timer 60 to run for another predetermined period of time (230), for example another 30 minutes. It is possible that the period of time between check messages could decrease each time the central timer is restarted. The monitor at station 12 attempts to call the subscriber (232). If no contact with the subscriber is made (234), the person monitoring the call attempts to call the responder (238), and if there is no response from the responder's location (242), the next responder on the list is contacted (120). If there is a response by a responder (242), the monitor (120) determines why the responder has not yet responded and may contact the next responder on the list if the present responder can not respond to the subscriber's call for help.

If contact (234) with the subscriber's home is successful, and help (250) is not needed the person monitoring the call closes the call (126). If further help is needed, the station 12 calls a responder or a succession of responders from the list maintained at the station until one of the responders answers and agrees to respond (118). In this manner, the central monitoring station 12 remains aware of the response status for the subscriber and call call additional responders until a positive indication occurs that someone will respond.

Additionally, the home communicator may be connected directly to various emergency sensors such as smoke detectors or intrusion sensors and may cause the home communicator 32 to generate a signal 42 unique to each of the detected conditions once one of the sensors has been triggered. For example, if the signal received (100) is a smoke detector signal (200), the system 12 posts the call to select one of the personnel at the central monitoring station (202). That person then attempts to establish contact (204) with the subscriber through the communicator 32, if the unit has that ability, or by phone otherwise. If voice contact is established with the subscriber (206) and help is requested (210), or if no voice contact is made (206), the fire department is called (216) and the call is considered closed (218). If voice contact is made (206) but no help is requested (220), the call is considered closed (218) without a call to the fire department. The same procedure may be followed in the case of an intrusion alarm signal, in which case the police or private security forces can be notified.

Other embodiments and modification are possible which fall within the scope of the claims and it is the intent to limit the scope of the invention only by the scope of the claims.

I claim:

1. A system for providing positive indication that a responder has arrived at a subscriber's location, said system comprising:

a central monitoring station;

a subscriber station capable of communication with said central monitoring station, said subscriber station comprising:

a home communicator for establishing communications between said home communicator and said central monitoring station;

a personal communicator for initiating said communication between said home communicator and said central monitoring station; and a local annunciator located at said subscriber station, for providing a tone indicating the central monitoring station has received a first help call from said subscriber station, and for indicating said central monitoring station has not received a communication from a responder who has arrived at said subscriber station; and a central timer located at said central monitoring station, said central timer capable of causing a warning message to be periodically generated at said central monitoring station, said central timer being started in response to said first help call from said subscriber station, wherein initiation of a subsequent help call from said subscriber station causes said local annunciator to stop generating said tone and also causing the central timer to stop thereby preventing the generation of said warning message.

2. The system of claim 1 further including a responder station capable of communication with said central monitoring station.

3. The system of claim 2 wherein said central timer is started subsequent to said central monitoring station transmitting a signal to said responder station in response to the first help call from said subscriber station.

4. The system of claim 1 wherein said central monitoring station comprises:

a central communicator, capable of communicating with said home communicator;

a processor for controlling said central communicator;

a monitor in communication with said processor, said monitor capable of displaying information as to whether help is still required at said subscriber station; and a keyboard in communication with said processor for issuing commands to said processor.

5. A method for providing positive indication that a responder has arrived at a subscriber's location, said method comprising the steps of:

transmitting a help-call from a subscriber station to a central monitoring station;

starting a central timer at said central monitoring station in response to said help-call from said subscriber station;

transmitting a start annunciator signal from said central monitoring station to said subscriber station in response to said help call;

starting a local annunciator at said subscriber station in response to said start annunciator signal from said central monitoring station;

notifying a responder that said help-call has been received from said subscriber station;

generating a status message at said central monitoring station in response to said central timer indicating a predetermined amount of time;

transmitting a subsequent help-call from said subscriber station to said central monitoring station in response to the arrival of said responder; and stopping said local annunciator and said central timer in response to the transmission of said subsequent help-call from said subscriber station thereby preventing the generating of said status message at said central monitoring station.

* * * * *